US006288348B1

(12) United States Patent
Eberts et al.

(10) Patent No.: US 6,288,348 B1
(45) Date of Patent: Sep. 11, 2001

(54) PNEUMATIC OPERATOR FOR CIRCUIT BREAKERS

(75) Inventors: William George Eberts, Moon Township; David Curtis Turner, Imperial, both of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/491,258

(22) Filed: Jan. 26, 2000

(51) Int. Cl.[7] ..... H01H 7/00; H01H 3/20

(52) U.S. Cl. ..... 200/33 R; 200/330

(58) Field of Search ..... 200/33 R–40, 200/50.01–50.4, 81 R–83 Z, 329–338

(56) References Cited

U.S. PATENT DOCUMENTS

| | | | | |
|---|---|---|---|---|
| Re. 30,295 | * | 6/1980 | Cleary et al. | 200/33 R X |
| 3,564,179 | | 2/1971 | Boersma et al. . | |
| 3,930,134 | | 12/1975 | Rostron et al. . | |
| 3,984,648 | | 10/1976 | Nakano et al. . | |
| 4,164,635 | * | 8/1979 | Finch et al. | 200/33 R |
| 4,384,182 | | 5/1983 | Imam . | |
| 4,553,115 | | 11/1985 | Grunert et al. . | |
| 4,626,638 | * | 12/1986 | Samples et al. | 200/331 |
| 4,642,726 | | 2/1987 | Matsko et al. . | |
| 4,990,873 | | 2/1991 | Grunert et al. . | |
| 5,196,658 | | 3/1993 | Gula . | |
| 5,367,982 | | 11/1994 | DeMoore et al. . | |
| 5,475,190 | * | 12/1995 | Smith et al. | 200/50.32 |
| 5,534,858 | | 7/1996 | Tinkham . | |
| 5,604,340 | | 2/1997 | Yamada et al. . | |

* cited by examiner

*Primary Examiner*—J. R. Scott
(74) *Attorney, Agent, or Firm*—Martin J. Moran

(57) ABSTRACT

A pneumatic operator has a reciprocally mounted actuator is mechanically coupled to an operating handle from a molded case circuit breaker or a molded case switch for moving the operating handle between an open position or, alternatively, to a closed position. The pneumatic operator includes a piston for driving a handle actuator assembly which is coupled to the handle. The pneumatic piston may be coupled to a remote high pressure gas source or to a high pressure gas cylinder located adjacent to the molded case circuit breaker. The pneumatic operator may be controlled either remotely or by a handle mounted adjacent to the circuit breaker.

26 Claims, 3 Drawing Sheets

PNEUMATIC OPERATOR FOR CIRCUIT BREAKERS

BACKGROUND OF THE INVENTION

1. Field of the Invention

The present invention relates to a pneumatic operator for a molded case circuit breaker, switches and the like and, more particularly, to a pneumatic operator having a reciprocally mounted actuator, adapted to be coupled to a circuit breaker operating handle, for moving the operating handle to an open position or, alternatively, to a closed position, which may be controlled from a remote location.

2. Description of the Prior Art

Molded case circuit breakers are generally used to provide overcurrent protection for various types of electrical equipment. However, in some applications, it is desirable to have a motor operator for the circuit breaker. Such motor operators make it easier to operate large circuit breakers and make remote operation of the circuit breaker possible. Such a remote control system is also useful for molded case switches. In such applications, electric operators have been provided that are adapted to be mechanically coupled to the operating handle of the circuit breaker or molded case switch. Both solenoid operators and motor operators are known. Examples of solenoid operators for molded case circuit breakers and switches are disclosed in U.S. Pat. Nos. 4,553,115 and 4,642,726, assigned to the same assignee as the present invention. However, such solenoid operators are generally slow acting. Motor operators, on the other hand, are generally provided with high speed electric motors that are comparatively faster acting than a solenoid operator. An example of a motor operator is disclosed in U.S. Pat. Nos. 4,990,873, and 5,196,658 assigned to the same assignee as the present invention.

Both solenoid operators and motor operators are adapted to be rigidly mounted relative to the circuit breaker or molded case switch to be in communication with the operating handle. Such operators may either be disposed within the circuit breaker or switch housing or mounted either on the side or in the front of the circuit breaker. Examples of solenoid operators for molded case circuit breakers are disclosed in U.S. Pat. Nos. 4,553,115 and 4,642,726. An example of a motor operator is disclosed in U.S. Pat. No. 4,990,873.

Electric operators require an energy source to function. The electric operator, however, must include means for manual operation. This requirement for manual operation, promulgated in Underwriter's Laboratories Standard No. UL 489, is to allow for manual operation of the circuit breaker in the event of loss of electric power to the electric operator. Electric operators may fail if operated frequently within a short period of time, or if breaker begins to act differently due to wear. Electric operators also require multiple parts, e.g., the parts in the electric motor as well the coupling to the circuit breaker, all of which are subject to wear.

Pneumatic operators have been used as remote operators for circuit breakers, see e.g. U.S. Pat. No. 3,930,134. These pneumatic operators, however, were not coupled to molded case circuit breakers having an exposed operating handle and did not include a manual control means.

Therefore there is a need for a mechanical operator for a molded case circuit breaker which uses fewer parts than an electric operator.

There is further need for a mechanical operator for a molded case circuit breaker that is not dependent on a remote source of energy.

SUMMARY OF THE INVENTION

These needs and other are satisfied by the present invention which provides a pneumatic operator for molded case circuit breakers and switches. The pneumatic operator is adapted to be coupled to an operating handle of a molded case circuit breaker, or switch, for driving the operating handle to an open position or, alternatively, to a closed position. The pneumatic operator may be operated repeatedly over a short period of time and remains functional when the circuit breaker begins to wear. The present invention also provides a pneumatic operator for a molded case circuit breaker or switch which includes provisions for manual operation.

Briefly, the present invention relates to an pneumatic operator for a molded case circuit breaker or switch which includes an actuator, formed from a pair of spaced apart rollers for capturing an operating handle of the circuit breaker, or switch to, allow the operating handle to be driven to an open position or, alternatively, to a closed position. The actuator is controlled by a pneumatic operator which includes a piston coupled to a pressurized fluid source. The pressurized fluid source may be a hard line or a high pressure cylinder. The pressurized fluid acts upon the piston causing the piston to move. A control valve directs the pressurized fluid to one side or the other of the piston, allowing the piston to drive the actuator into the open or closed position. The control valve may be controlled manually or may be coupled to an electric control system. If the control valve is coupled to an electric control system, the electric control system may be configured to be remotely operated.

DESCRIPTION OF THE DRAWINGS

These and other advantages of the present invention will become readily apparent upon consideration of the following detailed description and attached drawing, wherein.

DETAILED DESCRIPTION OF A PREFERRED EMBODIMENT

Figure 1:
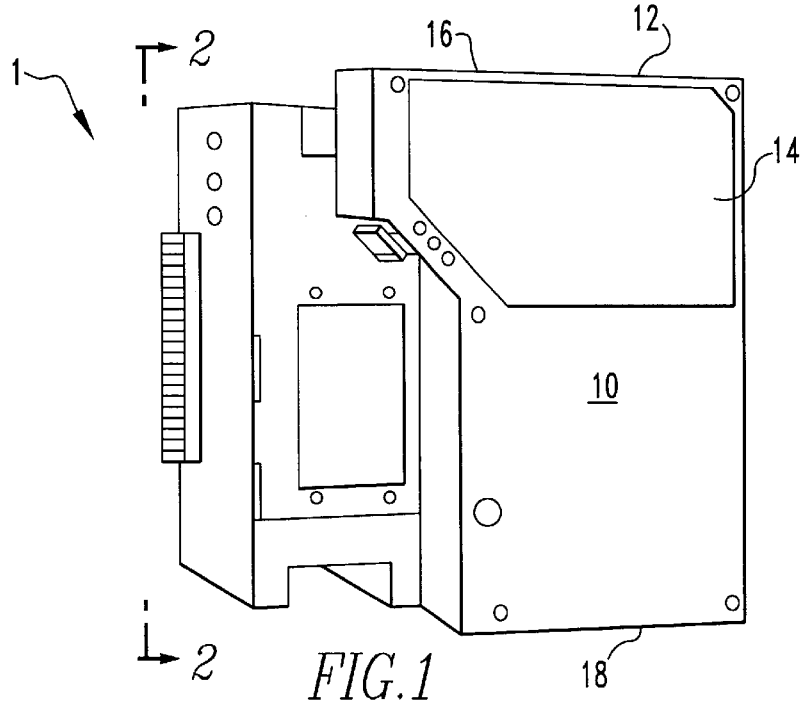
FIG. 1 is a perspective view of an pneumatic operator in accordance with the present invention rigidly mounted to a molded case circuit breaker.
Figure 2:
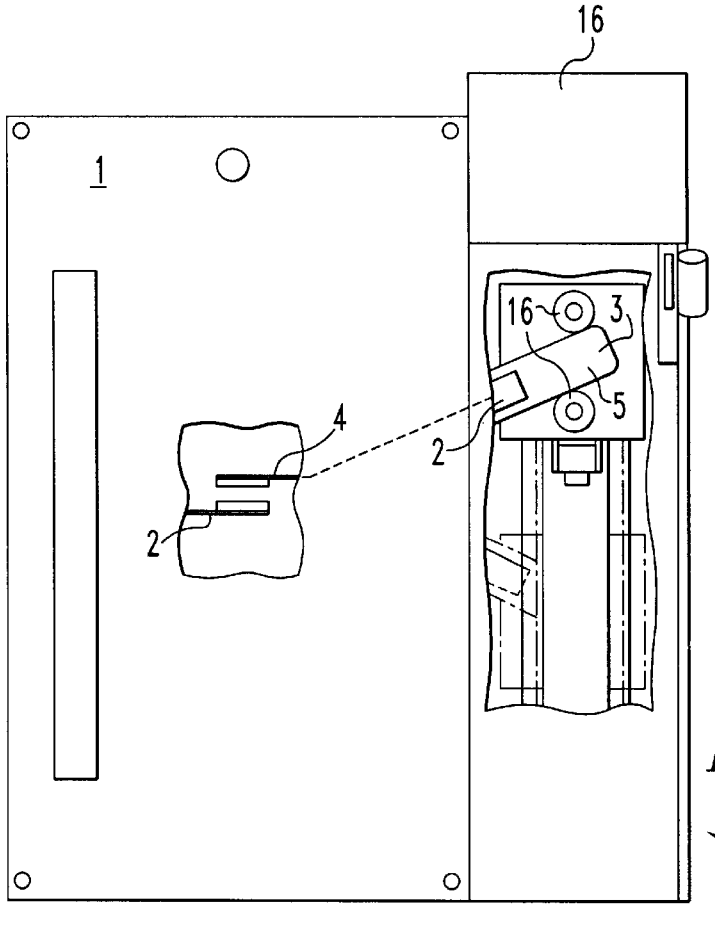
FIG. 2 is an elevational view along line 2—2 of FIG. 1 with a portion of the cover broken away, illustrating the pneumatic operator and the circuit breaker operating handle in alternate positions.

As shown in FIG. 1, a pneumatic operator 10 in accordance with the present invention disposed adjacent a molded case circuit breaker 1 or a molded case switch having an outwardly extending operating handle 2 (seen in FIG. 2). Such circuit breakers 1 and switches include a pair of separable main contacts 3, 4 controlled by the operating handle 2. The operating handle 2 has an open position, wherein the main contacts 3,4 are separated, and a closed position, where in the main contacts 3,4 are closed. A typical molded case circuit breaker 1 suitable for use with the pneumatic operator 10 is disclosed in U.S. Pat. No. 4,951,020, assigned to the same assignee as the assignee of the present invention, hereby incorporated by reference. The pneumatic operator 10 encloses the operating handle 2 to provide a flush exterior surface and eliminates inadvertent contact with the operating handle 2.

Figure 3:
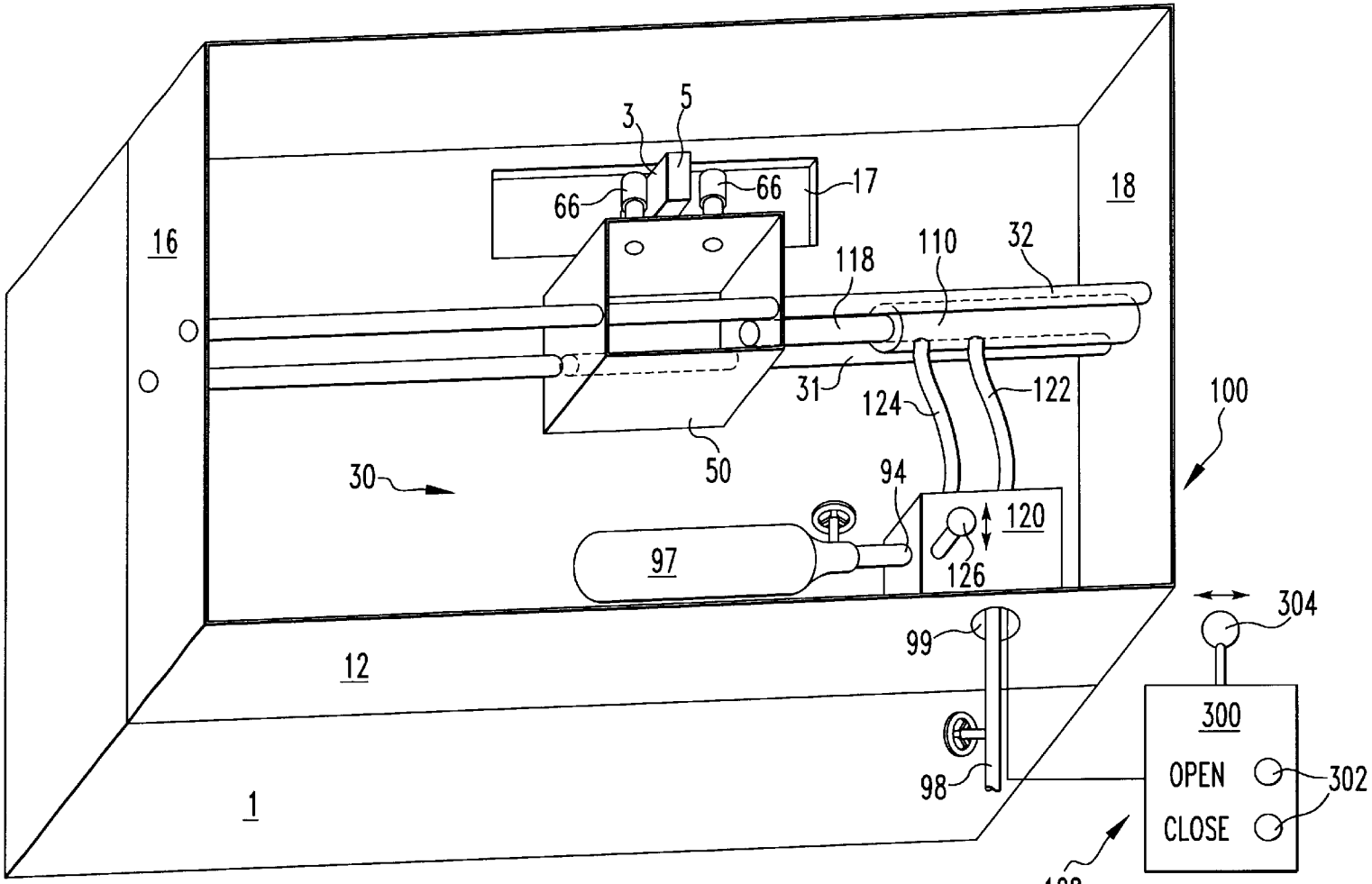
FIG. 3 is a perspective view of the pneumatic operator with the front cover removed.

The pneumatic operator 10 is disposed in a housing 12 having a removable cover 14, a top side 16 and a bottom side 18. As shown in FIG. 3, the housing 12 is provided with a rear access opening 17 for receiving the operating handle 2. The pneumatic operator 10 is mounted adjacent the molded case circuit breaker 1 or switch such that the operating handle 2 is aligned with the rear access opening 17 in the housing 12. A handle extension 3 may be used to extend the length of the operating handle 2, forming an operating handle assembly 5. The operating handle assembly 5 may then be mechanically coupled to a handle actuator assembly 30 and a pneumatic drive assembly 100 to enable the operating handle assembly 5 to be driven to the open position or, alternatively, to the closed position.

Figure 4:
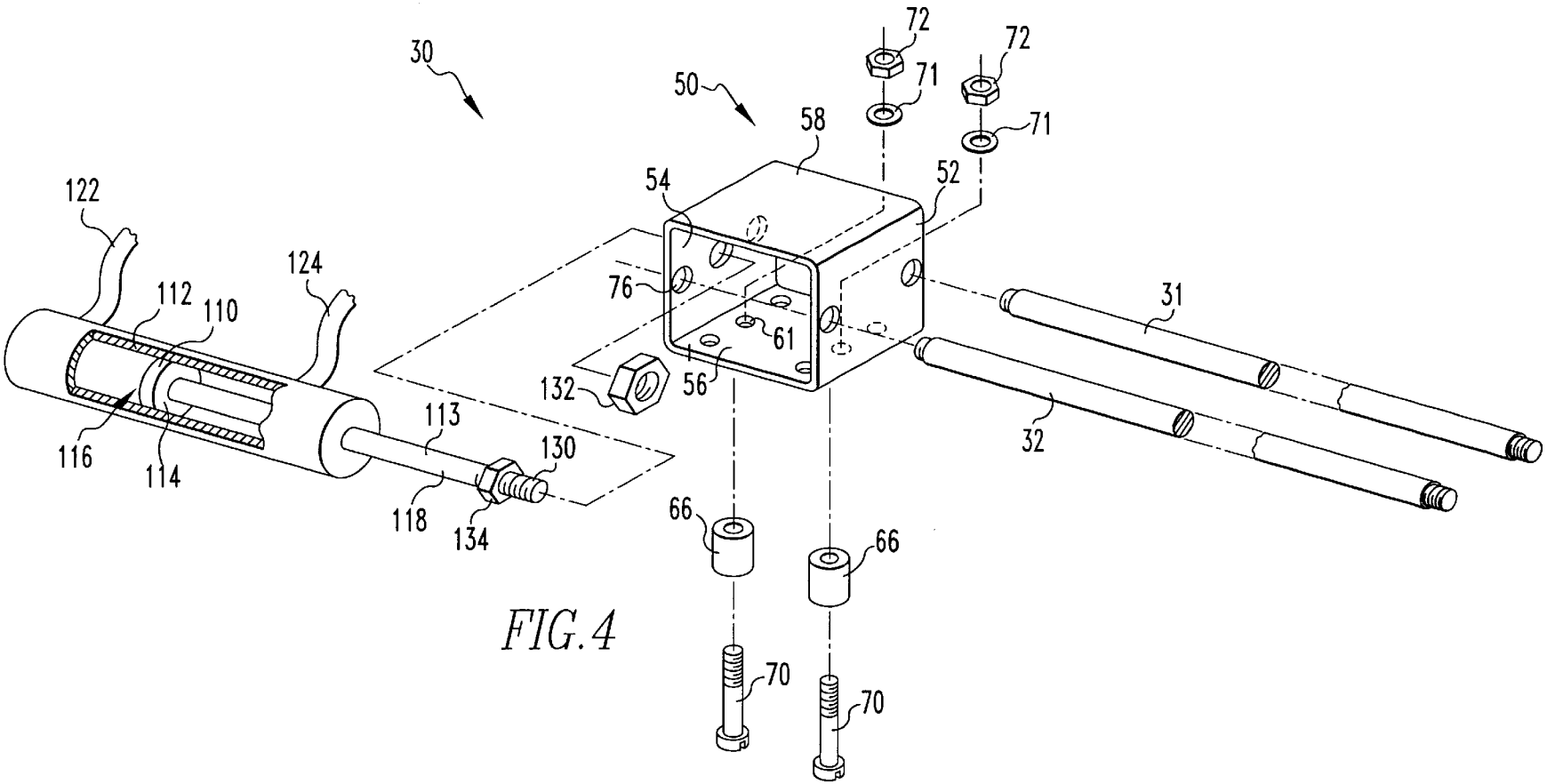
FIG. 4 is an exploded perspective view of a handle actuator assembly and air piston assembly in accordance with the present invention.

As shown in FIG. 4, the handle actuator assembly 30 includes a generally box-like frame 50 open on two sides. The frame 50 has a top side 52, a bottom side 54, a handle side 56 and a back side 58. A pair of spaced apart openings 61, 62 are provided on handle side 56 for mounting a pair of rollers 66. The rollers 66 are mounted for rotatable movement relative to the frame 50. More specifically, the rollers 66 are provided with centrally disposed openings 68 which, in turn, are aligned with the openings 61, 62 in the frame 50. Shoulder bolts 70, received in the aligned openings 68, are secured through openings 61, 62 to the frame 50 with suitable fasteners 72. As shown best in FIG. 2, the operating handle assembly 5 is received between the rollers 66.

The handle actuator assembly 30 is mounted for linear reciprocal movement relative to the housing 12. More specifically, the handle actuator assembly 30 is movably mounted relative to a pair of spaced apart guide rods 31, 32 received in aligned openings 76, 78 on frame top side 52 and frame bottom side 54. The guides 31, 32 are rigidly mounted on one end to housing top side 16 and bottom side 18 (FIG. 3).

The pneumatic drive assembly 100, shown in FIG. 4, is mechanically coupled to the handle actuator assembly 30 to drive the handle actuator assembly 30 between an open position and alternatively to a closed position. The drive assembly 100 includes an piston 110 within a cylinder 112, a control valve assembly 120 which selectively directs a fluid, such as air, through hoses 122, 124 to either side of piston 110. Piston 110 has a first side 114, and a second side 116. Actuator arm 118 extends from piston first side 114. Cylinder 112 is sealed on a first end 111 and a second end 113 having a medial opening (not shown) that allows actuator arm 118 to pass therethrough. A seal (not shown) is disposd within the second end 113 opening to prevent loss of air pressure. Cylinder 112 may be mounted on housing bottom side 18 between guide rods 31, 32.

Control valve assembly 120 has three distinct states; closed, open to hose 122 or open to hose 124. Control valve assembly 120 may be coupled to both a handle 126, for manual operation of the control valve, or an electronic control 128. The electronic control may further be coupled to a remote operating station 300. The remote operating station 300 may have indicators, such as lights 302, to indicate the status of the breaker, i.e. open or closed, as well as a control 304 for operating the pneumatic drive assembly 100. Either handle 126 or electronic control 128 will configure control valve assembly 120 to be in one of its three states. The default state is closed. When closed, control valve assembly 120 prevents the pneumatic fluid from passing therethrough.

The pneumatic drive assembly 100 may use any pneumatic fluid, however, a gas, such as air, is the preferred working fluid. The gas is supplied to the pneumatic drive assembly 100 at a pressure of about 60 psi. The gas enters the pneumatic drive assembly 100 through valve 99. The gas may be supplied by a hard line 98 coupled to a remote high pressure gas source, or to a pressurized gas cylinder 97 that may be disposed in housing 12. Pressurized gas cylinder 97 acts as a stored energy device allowing the pneumatic operator 10 to operate independently of other energy sources.

In order to drive the handle actuator assembly 30, actuator arm 118 is coupled thereto. More specifically, frame bottom side 54 includes a means to attach actuator arm 118 thereto. The attachment means may be any common means such as welding or a threaded end 130 on actuator arm 118 passing through an opening 55 in frame bottom surface 54. The threaded end 130 may be fitted with a nut 132 above and a nut below 134 frame bottom surface 54. Thus, by adjusting the position of nuts 132, 134 on threaded end 130, the position of frame assembly 50 may be adjusted relative to handle assembly 5.

In operation, the pneumatic operator 10 is positioned adjacent to a molded case circuit breaker 1. The handle assembly 5 of the molded case circuit breaker 1 is captured by rollers 66 on handle actuator assembly 30. An operator can drive handle actuator assembly 30 toward either the open or closed position manually by engaging handle 126 or electronic control 128. By engaging handle 126 or electronic control 128, the pneumatic fluid is directed to the appropriate side of piston 110, causing the piston to move actuator arm 118 and the actuator assembly 30.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A pneumatic operator for a molded case circuit breaker having a handle moveable, within a housing, from a closed position, through a trip position to an open position, said pneumatic operator comprising:

an operator housing disposed adjacent to said molded case circuit breaker;

a handle actuator assembly engaging said circuit breaker handle and mounted for reciprocal movement along a longitudinal axis for operating said handle between said closed and said open position; and a pneumatic means coupled to said handle actuator assembly for effecting said reciprocal movement of said handle actuator assembly;

said pneumatic means includes drive assembly having a control valve assembly for selectively enabling said pneumatic means to drive said handle actuator assembly to either said open position or said closed position.

2. The pneumatic operator of claim 1 wherein said valve assembly includes an electronic control;

said electronic control being linked to a remote operating station.

3. The pneumatic operator of claim 2 wherein said control valve assembly includes a handle for manual control.

4. The pneumatic operator of claim 3 wherein said control valve assembly can be controlled by either said manual control or said electronic control.

5. The pneumatic operator of claim 4 wherein said pneumatic means includes a gas as the working fluid.

6. The pneumatic operator of claim 5 wherein said gas is supplied by a pressurized gas line.

7. The pneumatic operator of claim 5 wherein said gas is supplied by a pressurized gas cylinder.

8. The pneumatic operator of claim 4 wherein said handle actuator assembly includes at least one guide rod disposed within said operator housing, extending in the direction of said reciprocal movement.

9. The pneumatic operator of claim 8 wherein said drive assembly includes:

a cylinder with a piston disposed therein;

an actuator arm extending from said piston and coupled to said handle actuator assembly;

said control valve assembly structured to provide said gas to either side of said piston.

10. The pneumatic operator of claim 2 wherein said pneumatic means includes a gas as the working fluid.

11. The pneumatic operator of claim 10 wherein said gas is supplied by a pressurized gas line.

12. The pneumatic operator of claim 10 wherein said gas is supplied by a pressurized gas cylinder.

13. A pneumatic operator for a molded case circuit breaker having a handle moveable, within a housing, from a closed position, through a trip position to an open position, said pneumatic operator comprising:

a housing disposed adjacent to said molded case circuit breaker;

a handle actuator assembly engaging said circuit breaker handle and mounted for reciprocal movement along a longitudinal axis for operating said handle between said closed and said open position;

a pneumatic operating means coupled to said handle actuator assembly for effecting said reciprocal movement of said handle actuator assembly; and a stored energy means for effecting said reciprocal movement of said handle actuator assembly;

said pneumatic means includes drive assembly having a control valve assembly for selectively enabling said pneumatic operating means to drive said handle actuator assembly to either said open position or said closed position.

14. The pneumatic operator of claim 13, wherein said stored energy means includes a pressurized gas cylinder coupled to said pneumatic operating means for effecting said reciprocal movement of said handle actuator assembly.

15. A molded case circuit breaker comprising:

at least one pair of main contacts within said circuit breaker movable between an open position and a closed position;

an operating handle coupled to said at least one pair of main contacts for moving said at least one pair of main contacts between sand open and closed positions;

an operator housing disposed adjacent to said molded case circuit breaker;

a handle actuator assembly engaging said circuit breaker handle and mounted for reciprocal movement along a longitudinal axis for operating said handle between said closed and said open position; and a pneumatic operating means coupled to said handle actuator assembly for effecting said reciprocal movement of said handle actuator assembly;

said pneumatic operating means includes drive assembly having a control valve assembly for selectively enabling said pneumatic means to drive said handle actuator assembly to either said open position or said closed position.

16. The molded case circuit breaker of claim 15 wherein said valve assembly includes an electronic control;

and electronic control being linked to a remote operating station.

17. The molded case circuit breaker of claim 16 wherein said control valve assembly includes a handle for manual control.

18. The molded case circuit breaker of claim 17 wherein said control valve assembly can be controlled by either said manual control or said electronic control.

19. The molded case circuit breaker of claim 18 wherein said pneumatic operating means includes a gas as the working fluid.

20. The molded case circuit breaker of claim 19 wherein said gas is supplied by a pressurized gas line.

21. The molded case circuit breaker of claim 19 wherein said gas is supplied by a pressurized gas cylinder.

22. The molded case circuit breaker of claim 19 wherein said handle actuator assembly includes at least one guide rod disposed within said operator housing, extending in the direction of said reciprocal movement.

23. The molded case circuit breaker of claim 22 wherein said drive assembly includes:

a cylinder with a piston disposed therein;

an actuator arm extending from said piston and coupled to said handle actuator assembly;

said control valve assembly structured to provide said gas to either side of said piston.

24. The molded case circuit breaker of claim 16 wherein said pneumatic operating means includes a gas as the working fluid.

25. The molded case circuit breaker of claim 24 wherein said gas is supplied by a pressurized gas line.

26. The molded case circuit breaker of claim 24 wherein said gas is supplied by a pressurized gas cylinder.

* * * * *